US005306002A

United States Patent [19]

Meyer

[11] Patent Number: 5,306,002

[45] Date of Patent: Apr. 26, 1994

[54] SEAMLESS BASKETBALL

[76] Inventor: Darin J. Meyer, 1028 Jessup Rd., Thorofare, N.J. 08086

[21] Appl. No.: 59,097

[22] Filed: May 10, 1993

[51] Int. Cl.[5] ..... A63B 41/08; A63B 45/02

[52] U.S. Cl. ..... 273/65 B; 273/65 C; 273/65 ED; 273/65 EG; 273/1.5 A; 40/327

[58] Field of Search ..... 273/65 R, 65 E, 65 ED, 273/65 EE, 65 EG, 1.5 A, 65 B, 65 C, 65 D, 58 B, 58 BA, 58 J; 40/327; 434/248

[56] References Cited

U.S. PATENT DOCUMENTS

| | | | |
|---|---|---|---|
| 1,543,724 | 6/1925 | Roberts et al. | 273/65 EE |
| 2,287,171 | 6/1942 | Goldsmith | 273/65 EG |
| 2,295,815 | 9/1942 | Webb | 273/65 EE |
| 5,181,717 | 1/1993 | Donntag et al. | 273/65 EE |

FOREIGN PATENT DOCUMENTS

| | | | |
|---|---|---|---|
| 662796 | 5/1963 | Canada | 273/65 EE |

*Primary Examiner*—George J. Marlo
*Attorney, Agent, or Firm*—Norman E. Lehrer

[57] ABSTRACT

A basketball having a surface devoid of lines caused by indentations, seams, stitching, indicia or the like for forming a uniform and continuous surface. The seamless basketball has a uniform stippling along its entire surface and integrally a part thereof. The ball is formed from a molded outer cover formed from two hemispheres having an inflatable bladder positioned therein. The inflation valve is hidden from view under the cover or, if exposed, is flush with the cover and of the same color as the cover. The lack of lines of any sort on the outer surface of the ball causes the ball to have no particular orientation. Therefore, the user of the seamless basketball is not inclined to align the ball in a particular fashion prior to shooting the same. As such, wasted time is eliminated and a quicker release and greater concentration is gained. Additionally, the ball is subject to a truer bounce because of the more uniform spherical nature of the same.

7 Claims, 1 Drawing Sheet

SEAMLESS BASKETBALL

BACKGROUND OF THE INVENTION

This invention relates to the game of basketball and, more particularly, to an improvement over the ball used in the game. The ball has no visually exposed lines, seams, stitching or the like. Accordingly, the bad habit of aligning a currently existing ball having outwardly exposed lines and seams in a particular orientation prior to shooting the ball is eliminated.

The game of basketball is one of speed, quickness and accuracy. Games can be won or lost in seconds or even tenths of a second. The reaction time of players to receive a quick pass and immediately take an open shot is an important aspect of winning a basketball game. Presently, basketballs inherently have a particular and deceivingly correct orientation. Basketballs generally have seams and/or indentations spanning the circumference of the ball along generally equally spaced segments. While such seams were necessary in the past for the construction of the ball, they are no longer necessary due to newer technologies in manufacturing the balls. However, they have endured over the years based on both tradition and the belief that the seams increase the ability of a player to grip the basketball.

The prior art is inclusive of basketball designs which have attempted to eliminate indentations caused by seams but have been unable to eliminate lines associated with the construction of the outer cover of the basketball. Accordingly, while the seams and/or stitching may be removed from sight, lines still exist which cause the ball to have a particular and seemingly correct orientation. The prior art also includes basketballs having more distinct patterns on the outer surface of the ball for assisting the player to align the ball in a particular orientation. This theory teaches the use of more visible designs for establishing a particular orientation for assisting the player in more quickly aligning the ball. However, it is believed in the present application and the theory behind the same that such particular designs for assisting in orientating the ball contribute to wasted time prior to the player taking a shot. The prior art does not disclose a basketball having absolutely no particular orientation to which the player would have no inclination for aligning the ball.

U.S. Pat. No. 2,129,237 to Riddell discloses a ball and a method of construction. The purpose of the invention is to provide a basketball having no outer seams and having a perfectly round shape. As such, the outer surface of the basketball is comprised of layers of leather being adhered to a core wherein the sections adhered to the core abut each other in a perfectly parallel manner. As such, there are ideally no indentations or ridges which alter the form of the basketball. However, inherent in the construction of the basketball via the application of a plurality of strips, lines along the outer surface are formed. While these lines are seams which ideally do not extend beyond the outer surface of the basketball nor project inwardly of the outer surface of the basketball, they are still visible. Therefore, unlike the present invention, a player still may be tempted to align the ball such that the lines thereon are in the horizontal or vertical orientation before shooting.

Similar to Riddell, is U.S. Pat. No. 2,221,533 to Voit, disclosing a playing ball which exhibits a decrease in the number of seams on the outside surface. This invention is a method of making inflatable athletic balls which includes basketballs. While the invention discusses, ideally, that the ball has no surface seams, similar to Riddell there are marginal seams on the outer surface. Therefore, the Voit patent still exhibits a particular orientation similar to that of the Riddell ball.

U.S. Pat. No. 1,926,615 to Drohnn discloses a substantially seamless ball used for soccer and kicking-type games. The purpose of the seamless nature of the ball is to construct one which is more perfectly round. The ball is essentially comprised of a plurality of layers of covers wherein the outer cover is comprised of two hemispheres of covering material. As such, a singular seam spanning one rotation around the circumference of the ball is necessary. However, unlike the instant invention, the ball does have one seam which gives it a particular orientation, and it is not particularly useful in the game of basketball.

The patent to Hynes, U.S. Pat. No. 5,165,685, discloses a game ball for use in basketball having many outer seams for use in gripping the basketball which is completely contrary to the concept behind the present invention. The ball comprises a plurality of circular areas disposed around each pole of the ball wherein the areas are defined by a plurality of indented seams so as to assist in gripping the ball. As is obvious from the patent, the Hynes patent discloses the opposite of what is being taught in the present invention.

Finally, U.S. Pat. No. 4,546,975 to Nimms discloses a method of allegedly increasing basketball shooting accuracy and awareness. As in Hynes, the method taught in Nimms is completely contrary to the instant invention. The ball includes markings on the outer surface of the same for sighting of the ball to the target by aligning the markings with the intended line of travel and then focusing on the markings as the ball travels to the target. The player is to observe the markings to determine if the ball is rotating in a uniform fashion. If so, the player can assume that his shooting technique and release are technically correct. Specific indicia markings are disclosed for basketballs. Nimms teaches that the player should align the particular indicia before shooting the ball, which, as discussed, causes delay on the part of the shooter and also a slower reaction time.

SUMMARY OF THE INVENTION

This invention is an improved basketball having an outer cover devoid of all lines, seams, stitching and other linear or directional markings which give current basketballs a particular orientation. The ball has a continuous and uniform stippling as a part of the outer cover and a valve which is hidden from view for maintaining the uniformity of the ball.

The invention is comprised of a spherical and air tight bladder positioned inside a molded spherical outer covering. The bladder is formed from a rubber material and it is inflatable via air forced through an integrally connected valve which extends to the outside surface of the ball yet preferably blends with the surface.

The outer covering is preferably a permeable and continuous molded piece of material formed into two hemispherical configurations. The outer cover has no lines or patterns thereon which could give the ball a particular orientation. As such, the outer cover is a continuously uniform surface. However, on and integral to the entire outer cover is stippling which is also uniformly positioned and dispersed. The stippling assists the basketball player in gripping the basketball.

The permeable nature of the outer cover material allows access to the valve while covering the same.

The seamless basketball is used like any other basketball but functions to eliminate the tendency of the shooter to align the ball in a horizontal or vertical orientation before shooting the same. Additionally, the ball has a more rounded shape such that it has a truer response to dribbling and bouncing and the like because of the lack of seams and indentations. Because of the ball's lack of a particular orientation, the shooter does not waste time aligning the ball and thereby gains valuable release time. In addition, the shooter can focus his attention on shooting the ball instead of lining the ball up in the proper orientation prior to shooting which may retract from the shooting process.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
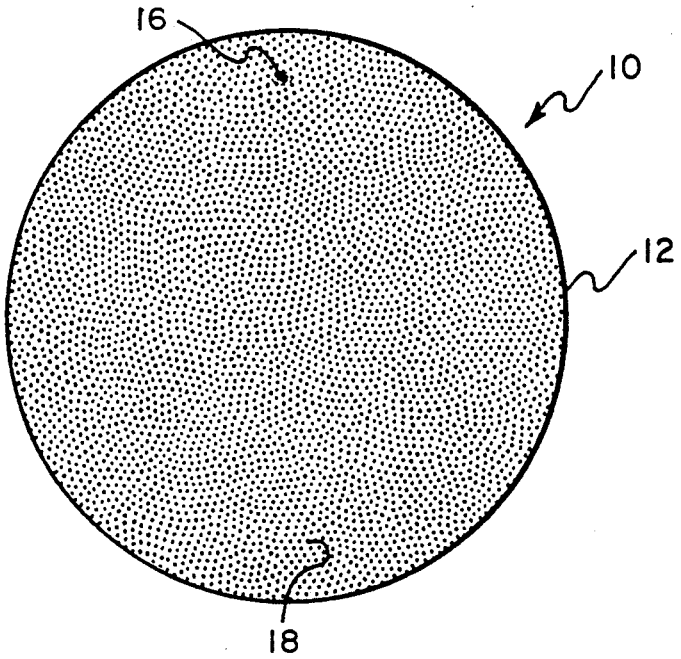
FIG. 1 is a perspective view of the seamless basketball showing the lack of a particular orientation of the ball and the continuous and uniform surface stippling.
Figure 3:
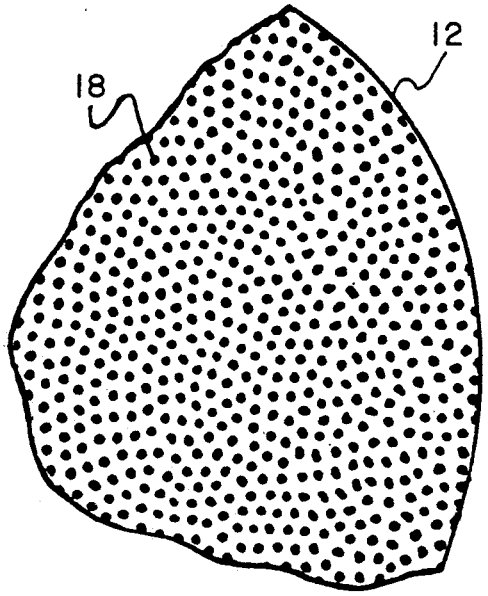
FIG. 3 is a sectional view of the basketball shown in FIG. 1 showing the uniformity and design of the continuous outer cover stippling.
Figure 2:
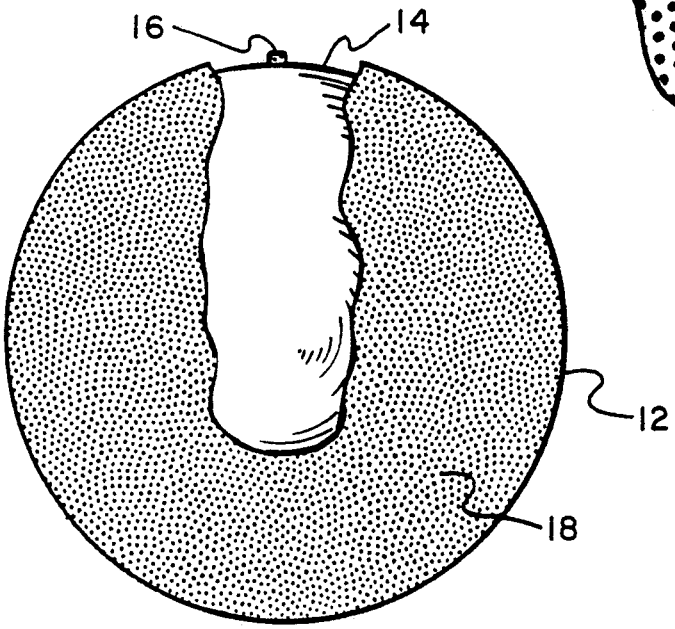
FIG. 2 is a cut-away view of FIG. 1 showing the bladder as it is positioned within the outer cover.

Referring now to the drawings in detail, wherein like reference numerals have been used throughout the various figures to designate like elements, there is shown in FIG. 1 a perspective view of the seamless basketball constructed in accordance with the principles of the present invention and designated generally as 10. The ball 10 is comprised of the outer cover 12, the inner bladder 14 (FIG. 2), the valve 16 and the stippling or raised gripping surface 18.

The outer cover 12, the inner bladder 14 and the stippling 18 may be similar in form and construction to a typical basketball. However, other constructions are possible so long as the essential feature of the elimination of all visually exposed lines and the like is achieved.

The outer cover 12 of the ball 10 is formed from molded and preferably permeable or resilient plastic, rubber, synthetic leather, leather or the like. The outer cover 12 is pre-formed into a spherical shape such that the sphere is comprised of two hollow hemispheres. The hemispheres are later joined together with the bladder 14 therebetween for forming the full spherical shape of the ball. Alternatively, the ball and outer cover may be formed by dipping the bladder 14 into a liquid rubber, plastic or the like and allowing the same to dry and harden thereon thereby forming the outer cover 12.

The permeable or resilient nature of the outer cover allows access to the bladder for inflation without visually exposing a valve means or the like and altering the continuous and uniform nature of the cover. As such, access to the bladder 14 is acquired by going through the outer cover 12 or by going between the hemispherical sections of the outer cover wherein the resiliency of the material functions to cover back up the valve means after access to the same is no longer required.

When using the hemispherical halves approach in constructing the ball, the resiliency of the cover halves similarly cause the abutment line between the halves to be undetectable by sight. To guarantee the undetectability of any lines, it is important to join the halves while they are still warm from the molding process so that the hemisphere edges coalesce and form the two halves into a continuous spherical mass. If further line reduction is necessary, heat may be pointedly applied in a careful manner to blend the edges.

The outer cover 12 is molded such that the stippling 18 is integrally a part of the outer surface. Alternatively, the outer surface of the ball may be subjected to a press or the like for forming the stippling thereon after formation of the ball especially if the dipping procedure is used. The stippling 18, comprised of a plurality of small bumps, is uniformly distributed over the entire surface of the outer cover 12 such that the stippling is generally evenly spaced relative to adjacent stippling. The stippling is for assisting the player in gripping the ball and rises from the surface 12 as a plurality of small bumps.

For leather balls, some of the stippling already formed on the leather may be coated with rubber. This extra coating may be applied to the ball in a spaced manner at gripping positions so as to facilitate easier gripping and to provide the feel of the rubber gripping seams found on existing leather balls. The additional layer of rubber is clear or the same color as the ball so as to be visibly undetectable.

The stippling rises sufficiently from the surface to allow and assist the player in gripping the ball but not in excess so as to affect the bounce of the ball and the trueness of the spherical shape. As discussed above, the cover and the stippling are preferably permeable and/or resilient at a particular spot so as to allow the engagement of an air needle with a valve located under the cover which leads to the bladder 14.

The bladder 14 is comprised of a flexible natural or synthetic material, preferably rubber, having the capacity to expand upon insertion of pressurized air therein. The bladder is of sufficient size to expand to the inner circumference of the outer cover so as to push outward on the same. Accordingly, the outward expansion of the bladder 14 causes the outer cover 12 to take on a rigid posture. This, in turn, allows the ball to be bounced in a manner in which a basketball should be bounced. Obviously, the bladder 14 must be air-tight except for air forced through the integral valve 16.

The valve 16 is connected to the bladder 14 so as to maintain the air tightness of the bladder except when the valve is caused to open via a connected pressurized air source. The preferred embodiment, shown in FIG. 1, includes the valve extending into the outer cover 12. However, the valve remains covered by the permeable outer cover 12 and can be accessed for inflation of the bladder by inserting an inflation needle through the outer cover and into the valve. A second embodiment of the valve arrangement includes the valve 16 extending from the bladder 14 to the outer surface of the outer cover 12 by passing through the outer cover 12. In this arrangement the valve is visible but disguised, being the same color as the outer cover 12. The valve, therefore, does not destroy the uniform nature of the cover 12 and is not a distraction.

The ball is used in typical fashion. As with a normal basketball, it is dribbled, passed and shot at the basket without change. However, during use of the basketball, the player will notice a truer bounce because of the truer spherical shape of the ball and will be less inclined and have no reason to waste valuable time in aligning the ball during passing and shooting the same. When the player aligns his body and hands to shoot the ball at the basket, unlike a normal basketball where the player would probably align the seams in a horizontal fashion with his hand before shooting, the player may simply set himself and shoot without being distracted by orientation causing lines, indicia, stitching, seams and the like. As a result, the basketball player will learn to release the basketball more quickly and with more concentration than with the use of the normal ball.

The ball is helpful to beginners and to veterans alike. However, the effect of the ball on veterans and beginners is somewhat different in that beginners would never develop the distracting habit of alignment, while veterans would learn to shed this habit due to the ball having no orientation to align.

The present invention may be embodied in other specific forms without departing from the spirit or essential attributes thereof and accordingly reference should be made to the appended claims rather than to the foregoing specification as indicating the scope of the invention.

What is claimed is:

1. A basketball for training basketball players to shoot without first aligning the ball in a particular orientation comprised of a substantially spherical outer cover including a value for inflating same, said outer cover being devoid of outwardly facing and visible lines, seams, stitching, indentations and indicia or other marking tending to give the appearance of said ball having a particular orientation, said outer cover having a substantially continuous and uninterrupted outer surface, said outer cover having stippling thereon, and said stippling being a continuous and uniform gripping surface formed from small bumps.

2. The invention according to claim 1 wherein said ball further comprises a substantially spherical inner bladder having means for inflation, said bladder being positioned inside said spherical outer cover.

3. The invention according to claim 2 wherein said valve is attached to the bladder for inflating it with air.

4. The invention according to claim 3 wherein said valve is hidden under the surface of said outer cover so as not to disrupt the continuous nature of said outer cover, said outer cover being devoid of a hole for accessing said valve, said cover being permeable and resilient for allowing access to said valve yet covering the same during nonuse.

5. The invention according to claim 4 wherein said outer cover is comprised of two hemispherically shaped halves, each of said halves having a substantially circular edge wherein said halves are joined together at said edges for forming said outer cover such that no line is visible at the adjoined edges.

6. The invention according to claim 5 wherein said valve is accessible between said adjoined edges, said halves covering said valve during nonuse of the same.

7. The invention according to claim 3 wherein said valve extends to the outer surface of said cover and is flush with the same, said valve being the same color as said cover.

* * * * *